US008517380B2

(12) United States Patent
Peters

(10) Patent No.: US 8,517,380 B2
(45) **Date of Patent: *Aug. 27, 2013**

(54) GAME OF CHANCE ENSURING A SINGLE WINNER

(75) Inventor: Darin L. Peters, Dallas, TX (US)

(73) Assignee: Gaming Properties, LLC, Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/619,247

(22) Filed: Sep. 14, 2012

(65) Prior Publication Data

US 2013/0012289 A1 Jan. 10, 2013

Related U.S. Application Data

(63) Continuation of application No. 12/316,313, filed on Dec. 11, 2008, which is a continuation-in-part of application No. 11/323,544, filed on Dec. 30, 2005, now Pat. No. 7,464,933.

(51) Int. Cl.
*A63F 3/06* (2006.01)

(52) U.S. Cl.
USPC ..... 273/139; 273/269

(58) Field of Classification Search
USPC ..... 273/139, 269; 463/17, 18, 19
See application file for complete search history.

(56) References Cited

U.S. PATENT DOCUMENTS 4,775,155 A * 10/1988 Lees ..... 273/139
7,464,933 B2 * 12/2008 Peters et al. ..... 273/269

* cited by examiner

*Primary Examiner* — Benjamin Layno
(74) *Attorney, Agent, or Firm* — Howison & Arnott, L.L.P.

(57) ABSTRACT

A 3-number bingo game adapted to ensure there can be only a single winner. The numbers from 1 to 75 are divided into fifteen groups of five numbers each. For each group, the unique 3-number combinations of the five numbers taken three at a time are determined and printed on game cards. A single winner is determined if the unique 3-number combination on a player's game card matches a winning set of three numbers randomly determined by the House.

26 Claims, 4 Drawing Sheets

| | | | | | | | | | | | | | | | |
|---|---|---|---|---|---|---|---|---|---|---|---|---|---|---|---|
| B | 1 | 2 | 3 | 4 | 5 | 6 | 7 | 8 | 9 | 10 | 11 | 12 | 13 | 14 | 15 |
| I | 16 | 17 | 18 | 19 | 20 | 21 | 22 | 23 | 24 | 25 | 26 | 27 | 28 | 29 | 30 |
| N | 31 | 32 | 33 | 34 | 35 | 36 | 37 | 38 | 39 | 40 | 41 | 42 | 43 | 44 | 45 |
| G | 46 | 47 | 48 | 49 | 50 | 51 | 52 | 53 | 54 | 55 | 56 | 57 | 58 | 59 | 60 |
| O | 61 | 62 | 63 | 64 | 65 | 66 | 67 | 68 | 69 | 70 | 71 | 72 | 73 | 74 | 75 |

5 35 50

| B | I | N | G | O |
|---|---|---|---|---|
| 1 | 16 | 31 | 46 | 61 |
| 2 | 17 | 32 | 47 | 62 |
| 3 | 18 | 33 | 48 | 63 |
| 4 | 19 | 34 | 49 | 64 |
| 5 | 20 | 35 | 50 | 65 |
| 6 | 21 | 36 | 51 | 66 |
| 7 | 22 | 37 | 52 | 67 |
| 8 | 23 | 38 | 53 | 68 |
| 9 | 24 | 39 | 54 | 69 |
| 10 | 25 | 40 | 55 | 70 |
| 11 | 26 | 41 | 56 | 71 |
| 12 | 27 | 42 | 57 | 72 |
| 13 | 28 | 43 | 58 | 73 |
| 14 | 29 | 44 | 59 | 74 |
| 15 | 30 | 45 | 60 | 75 |

FIG. 2A

| B | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| I | 16 | 17 | 18 | 19 | 20 | 21 | 22 | 23 | 24 | 25 | 26 | 27 | 28 | 29 | 30 |
| N | 31 | 32 | 33 | 34 | 35 | 36 | 37 | 38 | 39 | 40 | 41 | 42 | 43 | 44 | 45 |
| G | 46 | 47 | 48 | 49 | 50 | 51 | 52 | 53 | 54 | 55 | 56 | 57 | 58 | 59 | 60 |
| O | 61 | 62 | 63 | 64 | 65 | 66 | 67 | 68 | 69 | 70 | 71 | 72 | 73 | 74 | 75 |

FIG. 2B

GAME OF CHANCE ENSURING A SINGLE WINNER

CROSS-REFERENCE TO RELATED APPLICATIONS

This application is a continuation of U.S. patent application Ser. No. 12/316,313, filed Dec. 11, 2008, and entitled GAME OF CHANCE ENSURING A SINGLE WINNER, the specification of which is incorporated herein by reference. Application Ser. No. 12/316,313 is a continuation-in-part of U.S. patent application Ser. No. 11/323,544, filed Dec. 30, 2005, issued as U.S. Pat. No. 7,464,933 on Dec. 16, 2008, and entitled SINGLE WINNER BINGO GAME, the specification of which is incorporated herein by reference.

TECHNICAL FIELD

This invention relates to games of chance. More particularly, and not by way of limitation, the invention is directed to a game of chance such as 3-number bingo, and a method that guarantees a single unique winner.

BACKGROUND

Bingo is a game of chance played with a pool of numbers ranging from 1-75. There are many variations of the basic game of bingo, which is played on a square game-sheet having five rows and five columns forming 25 smaller squares. Each of the five columns is headed by one of the five letters in the word BINGO. The numbers 1-75 are divided into five groups of 15 numbers each, and each group of 15 numbers is associated with one of the letters in the word BINGO. In other words, the numbers 1-15 are associated with the letter 'B'; the numbers 16-30 are associated with the letter 'I'; the numbers 31-45 are associated with the letter 'N'; the numbers 46-60 are associated with the letter 'G'; and the numbers 61-75 are associated with the letter 'O'. On a player's game sheet, the five squares in each column are filled with five numbers randomly drawn from the 15 numbers associated with that column's letter. During the game, the house randomly draws numbers between 1 and 75, and players match the drawn numbers with numbers on their game sheet. The first player to match all of the numbers in any row, column, or diagonal of their game sheet is a winner. However, since the numbers on the game sheets are random, and the numbers drawn are also random, it is possible to have more than one simultaneous winner.

FIG. 1 is a flow chart illustrating the steps of another known version of playing bingo. In this version, rather than playing with a 25 square game sheet, players are provided with small cards similar to instant-win lottery tickets. When opened, each card is printed with three numbers in the range of 1-75. A player wins whenever the three numbers on the player's card have been called.

In the example shown in FIG. 1, it is assumed that 1,000 cards are distributed to players. This number, of course, may be more or less. At step 11, the House prints (or has a vendor print) a large number of cards with three random numbers in the range of 1-75. At step 12, the House distributes 1,000 cards to the players. At step 13, the house randomly calls numbers in the range of 1-75. Generally, the called numbers are displayed on a large flashboard visible to all players. The positioning of the called numbers on the flashboard has no significance to the game. The flashboard is merely utilized as an aid to remind players which numbers have been called.

The House continues to call random numbers, until one or more simultaneous winners are determined. At step 14, the House pays out winnings to the simultaneous winners, which may theoretically be anywhere in the range of 1-1,000 simultaneous winners.

It is often desirable from the perspective of the House and the players to have a single unique winner of a bingo game. If the House promised a particular prize to the winner, and there were several simultaneous winners, the House may have to pay out more than anticipated. On the other hand, if a fixed amount is available for the winner, and there are several winners, then the fixed amount must be split between the winners.

Prior art methods of playing bingo do not ensure a single unique winner of a bingo game. What is needed in the art is a bingo game and method that overcomes the shortcomings of prior art methods of playing bingo. The present invention provides such a bingo game and method.

SUMMARY

The present invention is directed to a method of playing a game of chance between a plurality of players and a House, wherein each player has a game piece comprising a set of indicators, and a winner is determined if a player's set of indicators matches a winning set of indicators randomly determined by the House. The method ensures there can be only a single winner. The method includes determining by the House, a pool of possible indicators; dividing the pool of possible indicators into a predefined number of divisions; and for each division, calculating the number of unique combinations of the indicators in the division taken in groups equal in size to the number of indicators in each player's set of indicators. Each unique combination is then associated with one of a plurality of game pieces. The method also includes providing the plurality of game pieces to the players; randomly determining the winning set of indicators; and determining a single winner as the player having the game piece with the set of indicators that matches the winning set of indicators.

In another embodiment, the present invention is directed to a method of playing 3-number bingo between a plurality of players and a House, wherein each player has a game card with a set of three numbers between 1 and 75 printed thereon, and a winner is determined if a player's set of numbers matches a winning set of three numbers randomly determined by the House. Again, the method ensures there can be only a single winner. The method includes dividing the numbers from 1 to 75 into fifteen groups of five numbers each; calculating for each group of five numbers, the number of unique 3-number combinations of the five numbers taken three at a time; and printing each unique 3-number combination on one of a plurality of game cards. The plurality of game cards are then provided to the players. The method also includes randomly determining the winning set of numbers; and determining a single winner as the player having the game card with the unique 3-number combination that matches the winning set of numbers.

In another aspect, the present invention is directed to a 3-number bingo game played between a plurality of players and a House, wherein the game is adapted so that there can be only a single winner. The game includes a plurality of game cards, each game card having a unique 3-number combination of numbers between 1 and 75 printed thereon; and means for the House to determine a winning set of three numbers matching one of the unique 3-number combinations.

BRIEF DESCRIPTION OF THE DRAWINGS

A more complete understanding of the present invention may be had by reference to the following Detailed Description when taken in conjunction with the accompanying drawings wherein:

FIGS. 2A and 2B are flashboards suitable for use with the bingo game of the present invention;

DETAILED DESCRIPTION

In one embodiment, the present invention is a 3-number bingo game and method of playing the game that ensures that there is only one winner. Each card eligible to play the game is printed with a unique 3-number combination. Therefore, the first player to match all three numbers on his card must be the only winner.

FIGS. 2A and 2B are flashboards suitable for use with the bingo game of the present invention. FIG. 2A illustrates a vertically oriented flashboard, and FIG. 2B illustrates a horizontally oriented flashboard. In the vertical orientation of FIG. 2A, there are five columns; each headed by one of the letters of the word BINGO, and each containing 15 sequential numbers. In the vertical orientation, each row contains five numbers, one from each of the five columns. In the horizontal orientation of FIG. 2B, there are five rows, each headed by one of the letters of the word BINGO, and each containing 15 sequential numbers. In the horizontal orientation, each column contains five numbers, one from each of the five rows.

Figure 1:
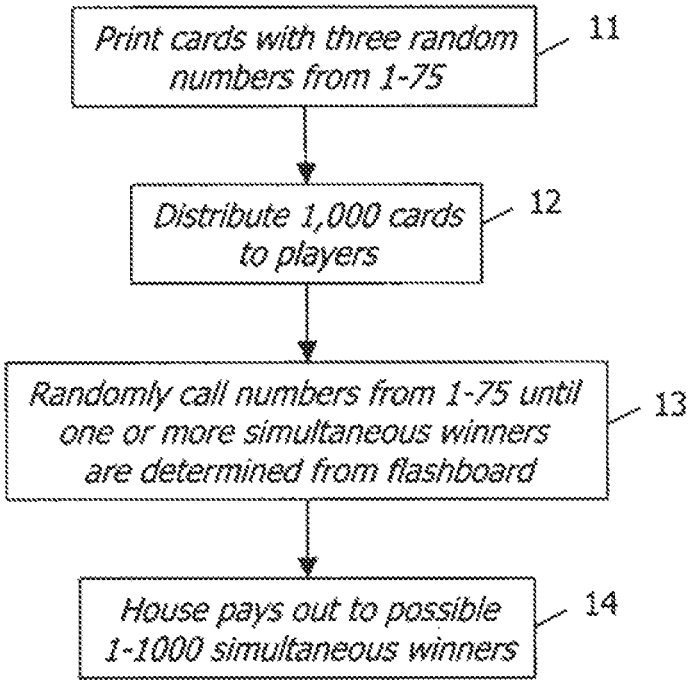
FIG. 1 (PRIOR ART)
FIG. 1 (Prior Art) is a flow chart illustrating the steps of a known method of playing bingo.
Figure 3:
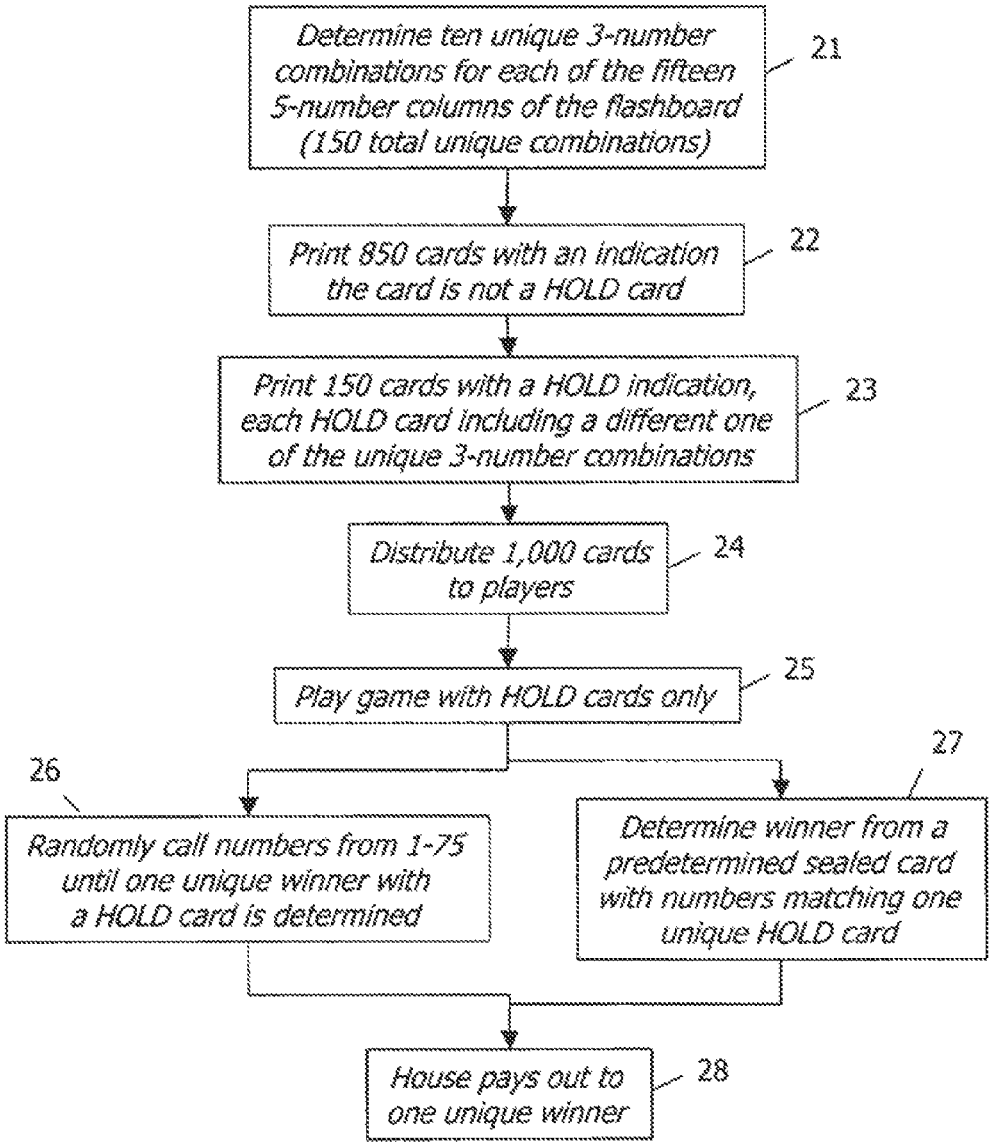
FIG. 3 is a flow chart illustrating the steps of an embodiment of a method of playing bingo in accordance with the teachings of the present invention.

FIG. 3 is a flow chart illustrating the steps of an embodiment of a method of playing bingo in accordance with the teachings of the present invention. At step 21, ten unique 3-number combinations are determined for each of the fifteen 5-number columns of the flashboard (assuming a horizontally oriented flashboard as shown in FIG. 2B). It can be shown mathematically that any set of five different numbers can be combined three at a time to form ten unique combinations. Mathematically, this is shown as follows:

$$\begin{aligned} {}^{5}C_3 &= 5!/(5-3)!\cdot 3! \\ &= 120/(2\cdot 6) \\ &= 120/12 \\ &= 10 \end{aligned}$$

Since the Dashboard has fifteen 5-number columns, there are a total of 150 unique 3-number combinations, when combinations are formed one column at a time. Assuming once again that 1,000 cards are to be distributed to players, 850 cards are printed at step 22 with an indication that the card is not a HOLD card (or alternatively, these cards are printed without an indication that the card is a HOLD card). At step 23, 150 cards are printed with a HOLD indication. Each HOLD card includes a different one of the 150 unique 3-number combinations. At step 24, the House distributes the 1,000 cards to the players. At step 25, the bingo game is played with the HOLD cards only.

A winner may be determined in alternative ways. At step 26, the House randomly calls numbers from in the range of 1-75, until one unique winner with a HOLD card is determined. Since each of the 150 3-number combinations on the HOLD cards is unique, there can be only one winner. Additionally, when combinations are formed one column at a time as described above, the House can quickly determine that there has been a winner whenever three numbers in any one column have been drawn. This is because each 3-number combination has been uniquely assigned to a single HOLD card.

In an alternative embodiment, a winner may be determined at step 27 by opening a predetermined sealed card matching one of the 150 unique 3-number combinations on the HOLD cards. Once again, there can be only one winner. From step 26 or 27, the method proceeds to step 28, where the House pays out to the one unique winner.

In the embodiment shown and described above, each HOLD card has a 1 in 150 chance of being a winner. The odds may be changed in other embodiments by computing different combinations and printing a set of HOLD cards reflecting the new combinations. For example, still referring to FIG. 2B, combinations may be computed for the number of combinations of the 15 numbers in each row taken three at a time. Mathematically, this is shown as follows:

$$\begin{aligned} {}^{15}C_3 &= 15!/(15-3)!\cdot 3! \\ &= (15\cdot 14\cdot 13)/6 \\ &= 2{,}730/6 \\ &= 455 \end{aligned}$$

Thus, there are 455 unique 3-number combinations in each row of the flashboard illustrated in FIG. 2B. Since the flashboard has five 15-number rows, there are a total of 455×5=2,275 unique 3-number combinations, when combinations are formed one row at a time. Thus in this embodiment, each HOLD card has a 1 in 2,275 chance of being a winner.

Other combinations of the numbers on the flashboard may also be utilized to achieve different odds of winning. At one extreme, if combinations are computed for all 75 numbers on the flashboard taken three at a time, it is found that there are 67,525 unique 3-number combinations. In such an embodiment, each HOLD card has a 1 in 67,525 chance of being a winner.

In another exemplary embodiment, intermediate odds of winning may be achieved by computing combinations on a per column basis for a predefined number of columns, and then computing combinations for the remaining partial rows. For example, combinations may be computed for the first eight 5-number columns in the manner shown in the first embodiment above. This calculation results in a total of 80 unique 3-number combinations. Combinations may then be calculated on a row-by-row basis for the remaining seven positions. For each partial row (i.e., positions nine through 15), there are 35 combinations of the seven numbers taken three at a time. Since there are five such partial rows, there are an additional 175 unique 3-number combinations. Thus, the total number of unique combinations in this embodiment is 80+175=255. If a hold card is printed for each unique 3-number combination, each HOLD card has a 1 in 255 chance of being a winner.

In each embodiment, since each HOLD card includes a unique 3-number combination, there can be only one winner.

Figure 4:
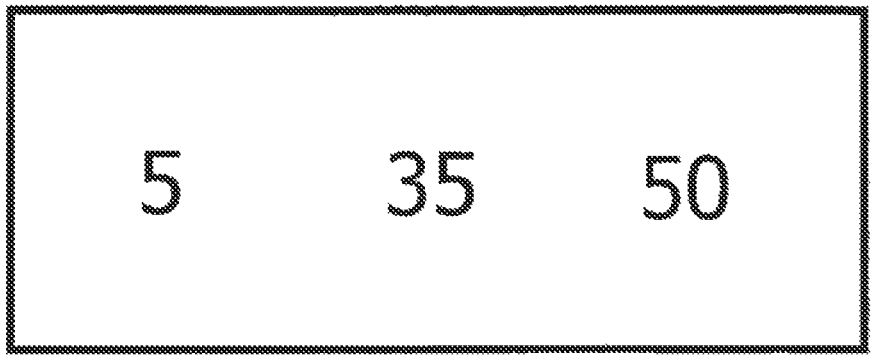
FIG. 4 is a game card with a set of three numbers between 1 and 75 printed thereon.

FIG. 4 is a game card with a set of three numbers between 1 and 75 printed thereon.

Figure 5:
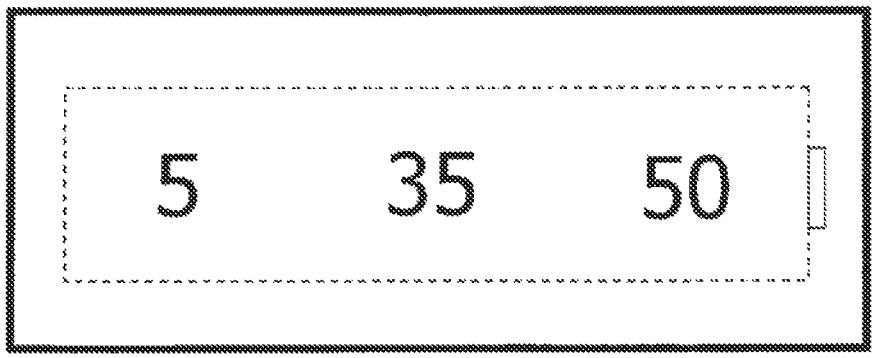
FIG. 5 is a sealed card for use by the House that contains the winning 3-number combination.

FIG. 5 is a sealed card for use by the House that contains the winning 3-number combination.

As will be recognized by those skilled in the art, the innovative concepts described in the present application can be modified and varied over a wide range of applications. For example, the pool of numbers being played may be greater or lesser than 75, and the HOLD cards may include greater or lesser than three numbers. The invention may also be utilized with indicators other than numbers such as letters or other symbols. Accordingly, the scope of patented subject matter should not be limited to any of the specific exemplary teachings discussed above, but is instead defined by the following claims.

What is claimed is:

1. A game of chance having $2^{nd}$ game of chance operating within the structure of a $1^{st}$ game of chance having defined $1^{st}$ game characteristics by a House wherein the game ensures that there can only be a single winning game piece in the $2^{nd}$ game of chance; the game comprising:

a flashboard provided by the House for use in the $1^{st}$ game of chance, the flashboard comprising a predetermined pool of indicators defined by the $1^{st}$ game characteristics organized in a fixed order in accordance with the $1^{st}$ game characteristics comprising a fixed number of rows and a fixed number of columns of indicators of the predetermined pool of indicators;

a $1^{st}$ set of game cards provided by the House for use in the $1^{st}$ game of chance, each game card in the $1^{st}$ set of game cards having at least a subset of the predetermined pool of indicators and each being adapted for receipt by players of the $1^{st}$ game of chance;

the $1^{st}$ game characteristics of the rows and columns established for the $1^{st}$ game of chance used to create for the $2^{nd}$ game of chance a plurality of divisions of indicators, wherein each division of indicators consists of mutually exclusive sets of a first number of the predetermined pool of indicators from one of one or more entire columns, rows or diagonals of the predetermined pool of indicators;

a second set of game pieces for use in the $2^{nd}$ game of chance adapted for receipt by a plurality of players; each game piece of the set of game pieces comprises:

for each division of indicators, a plurality of unique subsets of indicators of the first number of the predetermined pool of indicators making up each division of indicators, each unique subset of indicators having a second number of the predetermined pool of indicators, each unique subset of indicators being one of a plurality of indicator combinations derived from the first number of the predetermined pool of indicators making up the associated division of indicators, wherein all combinations of the first number of the predetermined pool of indicators for all of the divisions of indicators is exhausted, wherein each game piece contains only one unique subset of indicators, wherein a total number of the plurality of unique subsets of indicators is equal to a number of game pieces in the second set of game pieces; and wherein the unique set of indicators on each game piece is adapted to be viewed by players in receipt of the game pieces;

indicators being randomly selected, one at a time, from the predetermined pool of indicators for the $1^{st}$ game of chance during play of the $1^{st}$ game of chance until the randomly selected indicators coincide with a first unique set of indicators corresponding to any one of the second number of the predetermined pool of indicators that is contained within any of the unique subsets of indicators; and for the $2^{nd}$ game of chance a single winning game piece is determined from among the second set of game pieces, the single winning game piece being the one game piece comprising the first unique set of indicators.

2. The game according to claim 1, wherein the single winning game piece is further determined when the second number of indicators are selected from a same division of indicators of the plurality of divisions of indicators.

3. The game according to claim 1, wherein the $1^{st}$ game of chance is a game of BINGO and the pool of possible indicators consists of 75 indicators being the numbers from 1 to 75.

4. The game according to claim 3, wherein the fixed number of rows is equal to 5 and the fixed number of columns is equal to 15.

5. The game according to claim 4, wherein the second number of the predetermined pool of indicators is equal to 3.

6. The game according to claim 4, wherein the second number of the predetermined pool of indicators is 4.

7. The game according to claim 3, wherein each division of indicators consists of mutually exclusive sets of a first number of the predetermined pool of indicators from one entire column of the predetermined pool of indicators, wherein there are 15 columns on the flashboard and wherein the first number of the predetermined pool of indicators is equal to 5.

8. The game according to claim 7, wherein the second number of the predetermined pool of indicators is equal to 3 such that when all combinations of the first number of the predetermined pool of indicators for all of the divisions of indicators is exhausted, there are 150 unique subsets of indicators.

9. The game according to claim 1, wherein after the single winning game piece is determined, indicators are randomly selected, one at a time, from the pool of predetermined indicators until there are one or more winners of the $1^{st}$ game.

10. The game according to claim 1, wherein the indicators from the pool of predetermined indicators are randomly selected by opening a sealed card that contains a randomly selected first unique set of indicators corresponding to one of the second number of the predetermined pool of indicators that is contained within any of the unique subsets of indicators.

11. A game of chance adapted for play between a plurality of players and a House, wherein the game of chance is adapted so that there can be only a single winner, said game of chance comprising:

a predetermined number of game pieces adapted for distribution to the plurality of players, each of the game pieces comprises:

a set number of indicators, wherein each set number of indicators is a unique combination of indicators selected from one of a predefined number of indicator divisions, wherein each indicator division consists of a different set of indicators selected from a pool of possible indicators being organized in a fixed order having a fixed number of rows and a fixed number of columns, wherein the set number of indicators is fewer than a number of indicators in each of the indicator divisions;

wherein the predetermined number of game pieces is equal to a total number of unique combinations of indicators calculated based on the set number of indicators, the number of indicators in each of the indicator divisions and the number indicators in the pool of possible indicators; and wherein a game piece of the game of chance becomes a winning game piece of the game of chance when randomly selected indicators, from the pool of possible indicators, match one of the unique combinations of indicators on one of the game pieces.

12. The game of chance according to claim 11, wherein the set number of indicators is equal to 3 indicators, the predefined number of indicator divisions is equal to 15 indicator divisions, and the number of indicators in the pool of possible indicators is equal to 75 indicators.

13. The game of chance according to claim 11, wherein the set of indicators is equal to 4 indicators, the predefined number of indicator divisions is equal to 15 indicator divisions and the number of indicators in the pool of indicators is equal to 75.

14. The game of chance according to claim 11, further comprising use of a bingo flashboard and wherein the pool of possible indicators consists of the numbers from 1 to 75.

15. A multi-indicator game operating within the structure of a $1^{st}$ game of chance having defined $1^{st}$ game characteristics, the multi-indicator game and the $1^{st}$ game of chance adapted for play between a plurality of players and a House, wherein the $1^{st}$ game characteristics comprise a displayboard for players of the $1^{st}$ game of chance to view, the displayboard comprises a predetermined pool of indicators defined by the $1^{st}$ game characteristics organized in an order in accordance with the $1^{st}$ game characteristics comprising a number of rows and a number of columns of indicators of the predetermined pool of indicators, wherein the $1^{st}$ game characteristics further comprise a $1^{st}$ game set of game cards for use by players of the $1^{st}$ game of chance having at least a subset of the predetermined pool of indicators, the multi-indicator game comprising:

a pool of P indicators selected from the predetermined pool of indicators defined by the $1^{st}$ game characteristics;

a plurality of D division of indicators defined by the $1^{st}$ game characteristic rows and columns of indicators from the predetermined pool of indicators, wherein each of the D divisions of indicators consists of mutually exclusive sets of indicators from the pool of P indicators from one of one or more entire columns, rows or diagonals of the displayboard defined by the $1^{st}$ game characteristics;

a plurality of unique subsets of indicators from the associated mutually exclusive set of indicators calculated for each of the D division of indicators, each unique subset of indicators having a number N of indicators that is less than a number of indicators in the associated division of indicators, each unique subset of indicators being one of a total number of unique indicator combinations derived from each of the mutually exclusive sets of indicators making up the associated D division of indicators, wherein all unique combinations of N indicators from each mutually exclusive set of indicators making up the associated D divisions of indicators is exhausted, and wherein P, D, and N are integers;

a set of game pieces, for the multi-indicator game, wherein each game piece in the set of game pieces comprise a different unique subset of indicators of the total number of unique indicator combinations and wherein each game piece in the set of game pieces is configured to enable a player to view the different unique subset of indicators comprised thereon;

the multi-indicator game adapted to be played simultaneously with the $1^{st}$ game of chance when all the game pieces in the set of game pieces have been distributed to players, such that when the House randomly selects indicators, one at a time, from the predetermined pool of indicators from the $1^{st}$ game of chance during play of the $1^{st}$ game of chance, when the randomly selected indicators in the $1^{st}$ game of chance coincide with a first unique set of indicators corresponding to any one of the total number of unique indicator combinations, then the game piece comprising the unique indicator combination is a winning game piece and a one and only winning game piece.

16. The multi-indicator game of claim 15, wherein one of the D divisions of indicators consists of a different number of indicators from the pool of P indicators than another one of the D divisions of indicators.

17. The multi-indicator game of claim 15, wherein each game piece in the set of game pieces includes a hold indicia so as to differentiate the game pieces from additional game pieces added to the set of game pieces.

18. The multi-indicator game of claim 15, wherein, during play of the $1^{st}$ game of chance, one and only one winning game piece in the multi-indicator game exists when N indicators in one of the D divisions of indicators have been randomly selected.

19. The multi-indicator game of claim 15, wherein the predetermined pool of indicators coincide with numbers in rows and columns on a bingo flashboard.

20. The multi-indicator game of claim 15, where N is an integer greater or equal to 2 and less than a number of indicators in any of the divisions of indicators.

21. The multi-indicator game of claim 15, wherein each of the indicators in the predetermined pool of indicators comprises an icon, alphanumeric symbol or avatar.

22. A $2^{nd}$ game of chance adapted for play between a plurality of players and a House simultaneously during the play of a first game of chance, wherein the $1^{st}$ game of chance comprises $1^{st}$ game characteristics that includes a display comprising a predetermined pool of indicators organized in a fixed order having a fixed number of rows and a fixed number of columns of indicators of the predetermined pool of indicators, wherein the $2^{nd}$ game of chance is adapted so that there can be only a single winner, said $2^{nd}$ game of chance comprising:

a set of game pieces adapted for distribution to the plurality of players, each of the game pieces comprises:

a unique subset of indicators having a set number of indicators, wherein each unique subset of indicators is a unique combination of indicators selected from one of a predefined number of indicator divisions, wherein each indicator division consists of a mutually exclusive set of indicators selected from one of one or more entire columns, rows or diagonals of the predetermined pool of indicators and the number of indicators in each indicator division is greater than the set number of indicators;

wherein the number of game pieces in the set of game pieces is equal to a total number of unique subsets of indicators having the set number of indicators, calculated based on the number of indicators in each of the indicator divisions combined into unique subsets having the set number of indicators in each unique subset for each division; and wherein a game piece of the $2^{nd}$ game of chance becomes a winning game piece of the $2^{nd}$ game of chance when randomly selected indicators, from the predetermined pool of indicators, match one of the unique subsets of indicators on one of the game pieces.

23. The $2^{nd}$ game of chance of claim 22, wherein the winning game piece exists when a number of the randomly selected indicators, equal to the set of number of indicators, are all included in only one indicator division.

24. The $2^{nd}$ game of chance of claim 22, wherein each of the game pieces in the set of game pieces comprises a hold indicia.

25. The $2^{nd}$ game of chance of claim 22, wherein the set number of indicators is equal to 3, the predetermined number of indicator divisions is equal to 15, and each indicator division consists of a mutually exclusive set of indicators selected from one entire column of 5 indicators of the pool of predetermined indicators of the $1^{st}$ game.

26. The $2^{nd}$ game of chance of claim 22, wherein the set number of indicators is equal to 4, the predetermined number of indicator divisions is equal to 15, and each indicator division consists of a mutually exclusive set of indicators selected from one entire column of 5 indicators of the pool of predetermined indicators of the $1^{st}$ game.

* * * * *